US005683192A

United States Patent [19]

Kilfoil

[11] Patent Number: 5,683,192

[45] Date of Patent: Nov. 4, 1997

[54] TOOTHBRUSH SYSTEM WITH AN INTERNAL WATER DELIVERY SYSTEM OPERABLE FROM A SHOWER

[76] Inventor: Dennis C. Kilfoil, 1277 32nd Ct. NW., Salem, Oreg. 97304

[21] Appl. No.: 632,002

[22] Filed: Apr. 15, 1996

[51] Int. Cl.[6] ..... A46B 11/06

[52] U.S. Cl. ..... 401/289; 401/42; 401/280

[58] Field of Search ..... 401/280, 289, 401/43, 42

[56] References Cited

U.S. PATENT DOCUMENTS

| | | | |
|---|---|---|---|
| 2,303,667 | 12/1942 | Taborski | 401/43 X |
| 4,863,302 | 9/1989 | Herzfeld et al. | 401/289 X |
| 4,998,836 | 3/1991 | Scripnick | 401/46 X |
| 5,339,469 | 8/1994 | Gilles | 401/43 X |

FOREIGN PATENT DOCUMENTS

| | | | |
|---|---|---|---|
| 2561884 | 10/1985 | France | 401/289 |
| 882049 | 6/1988 | Rep. of Korea | 401/289 |

*Primary Examiner*—Steven A. Bratlie

[57] ABSTRACT

A toothbrush system with an internal water delivery system is disclosed. A hollow cylindrical adapter is removably positionable on a shower between the water outlet line and the shower head. The adapter has an inlet end with threads for coupling to the water outlet line bringing water to the shower head. It also has an outlet end with threads for coupling to the shower head. In addition, the adaptor has a radial aperture with a threaded extension. A toothbrush has a far end with outwardly extending bristles and a near end with a rectilinear-shaped female connector. It also has at least one line extending along the length thereof with a plurality of apertures adjacent to the bristles at the terminal ends of the lines for the dissemination of water from the lines and through the apertures. A hose has an upper end with a fitting formed with threads for coupling with the threads of the nipple of the adapter. It also has a lower end for receiving the near end of the toothbrush.

1 Claim, 4 Drawing Sheets

TOOTHBRUSH SYSTEM WITH AN INTERNAL WATER DELIVERY SYSTEM OPERABLE FROM A SHOWER

BACKGROUND OF THE INVENTION

1. Field of the Invention

The present invention relates to a new and improved toothbrush system with an internal water delivery system operable from a shower and, more particularly, pertains to utilizing the water of a bathroom shower or sink for internally delivering water to the toothbrush at the bristle end while showering.

2. Description of the Prior Art

The use of toothbrushes of various designs and configurations is known in the prior art. More specifically, toothbrushes of various designs and configurations heretofore devised and utilized for the purpose of internally delivering water to toothbrushes through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for utilizing the water of a bathroom shower or sink for internally delivering water to the toothbrush at the bristle end while showering. By way of example, U.S. Pat. No. 3,610,234 to Oates discloses a toothbrush equipped with a specialized water jet exit orifice which provides for improved cleaning of teeth and stimulation of gums.

U.S. Pat. No. 4,783,871 to Rich, Jr. discloses a water powered rotary toothbrush.

U.S. Pat. No. 5,304,010 to Hsing-San discloses a toothbrush containing a water reservoir within the handle itself.

U.S. Pat. No. 5,338,124 to Spicer et al. discloses a water squirt toothbrush with fluid chamber.

Lastly, U.S. Pat. No. Des. 318,918 to Hartwein discloses the ornamental design for a combined water jet and toothbrush unit.

In this respect, the toothbrush system with an internal water delivery system operable from a shower according to the present invention substantially departs from the conventional concepts and designs of the prior art, and in doing so provides an apparatus primarily developed for the purpose of utilizing the water of a bathroom shower or sink for internally delivering water to the toothbrush at the bristle end while showering.

Therefore, it can be appreciated that there exists a continuing need for a new and improved toothbrush system with an internal water delivery system operable from a shower which can be used for utilizing the water of a bathroom shower or sink for internally delivering water to the toothbrush at the bristle end while showering. In this regard, the present invention substantially fulfills this need.

SUMMARY OF THE INVENTION

In view of the foregoing disadvantages inherent in the known types of toothbrushes of various designs and configurations now present in the prior art, the present invention provides an improved toothbrush system with an internal water delivery system operable from a shower. As such, the general purpose of the present invention, which will be described subsequently in greater detail, is to provide a new and improved toothbrush system with an internal water delivery system operable from a shower and methods which have all the advantages of the prior art and none of the disadvantages.

To attain this, the present invention essentially comprises a new and improved toothbrush system with an internal water delivery system operable from a shower. The system comprises, in combination, a hollow cylindrical adapter removably positionable on a shower between the water outlet line and the shower head, the adapter having an inlet end with internal threads for coupling to the water outlet line bringing water to the shower head and having an outlet end with external threads for coupling to the shower head, the adaptor having a centrally disposed radial aperture with a threaded extension, the adaptor also having a rotatable ball-shaped valve with a T-shaped opening to direct the flow of water to the shower head to the exclusion of the radial aperture, to the radial aperture to the exclusion of the shower head, to neither the shower head nor the radial aperture and with a portion of the flow of water to the shower head and radial aperture; a toothbrush having a far end with outwardly extending bristles and a near end with a rectilinear-shaped female connector and with a pair of parallel lines extending along the length thereof with a plurality of apertures adjacent to the bristles at the terminal ends of the lines for the dissemination of water from the lines and through the apertures; and a flexible hose having an upper end with a fitting formed with internal threads for coupling with the threads of the nipple of the adapter and having a lower end shaped in rectilinear configuration for receiving the near end of the toothbrush, the lower end of the hose having an annular recess with an associated O-ring for making a watertight seal between the toothbrush and the lower end of the hose, the toothbrush also having a radially outstanding flange adapted to be received in a radial recess in the lower end of the hose for the coupling therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toothbrush system with an internal water delivery system operable from a shower which has all the advantages of the prior art toothbrushes of various designs and configurations and none of the disadvantages.

It is another object of the present invention to provide a new and improved toothbrush system with an internal water delivery system operable from a shower which may be easily and efficiently manufactured and marketed.

It is a further object of the present invention to provide a new and improved toothbrush system with an internal water delivery system operable from a shower which is of a durable and reliable construction.

An even further object of the present invention is to provide a new and improved toothbrush system with an internal water delivery system operable from a shower which is susceptible of a low cost of manufacture with regard to both materials and labor, and which accordingly is then susceptible of low prices of sale to the consuming public, thereby making such toothbrushes of various designs and configurations economically available to the buying public.

Still yet another object of the present invention is to provide a new and improved toothbrush system with an internal water delivery system operable from a shower which provides in the apparatuses and methods of the prior art some of the advantages thereof, while simultaneously overcoming some of the disadvantages normally associated therewith.

Even still another object of the present invention is to utilize the water of a bathroom shower or sink for delivering water to the toothbrush at the bristle end.

Lastly, it is an object of the present invention to provide a toothbrush system with an internal water delivery system. A hollow cylindrical adapter is removably positionable on a shower between the water outlet line and the shower head. The adapter has an inlet end with threads for coupling to the water outlet line bringing water to the shower head. It also has an outlet end with threads for coupling to the shower head. In addition, the adaptor has a radial aperture with a threaded extension. A toothbrush has a far end with outwardly extending bristles and a near end with a rectilinear-shaped female connector. It also has at least one line extending along the length thereof with a plurality of apertures adjacent to the bristles at the terminal ends of the lines for the dissemination of water from the lines and through the apertures. A hose has an upper end with a fitting formed with threads for coupling with the threads of the nipple of the adapter. It also has a lower end for receiving the near end of the toothbrush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
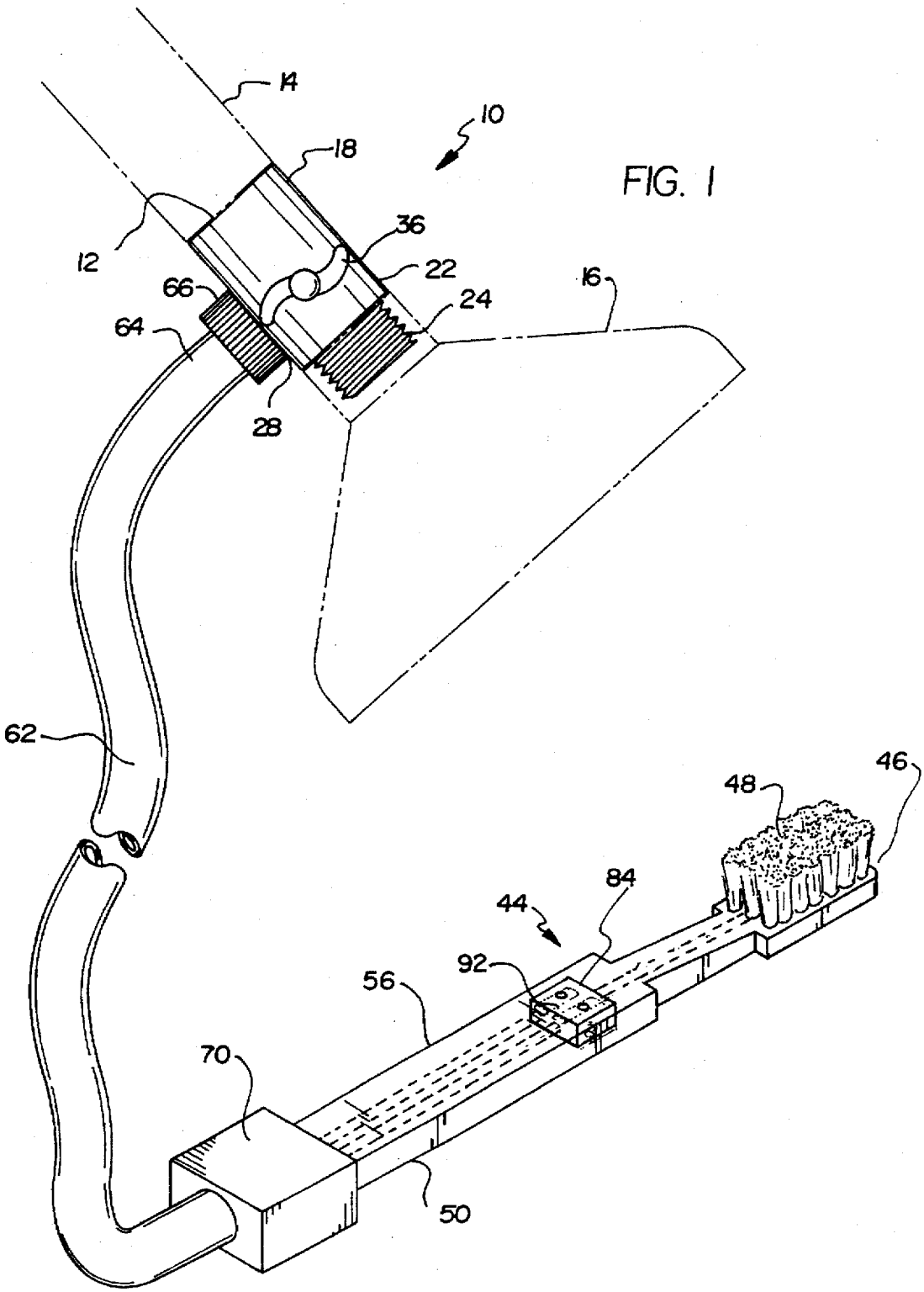
FIG. 1 is a perspective illustration of the preferred embodiment of the new and improved toothbrush system with an internal water delivery system operable from a shower constructed in accordance with the principles of the present invention.
Figure 2:
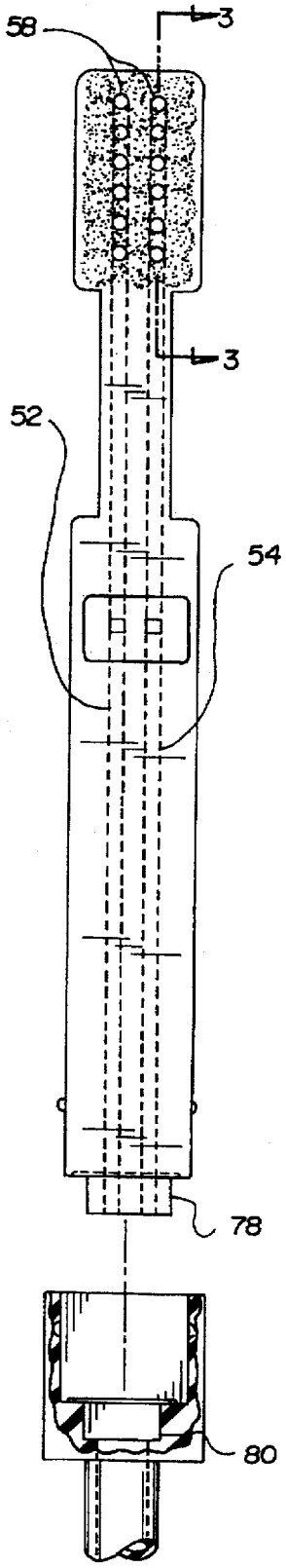
FIG. 2 is a front elevational view of the toothbrush shown in the prior Figure with parts broken away to show certain internal constructions thereof.
Figure 3:
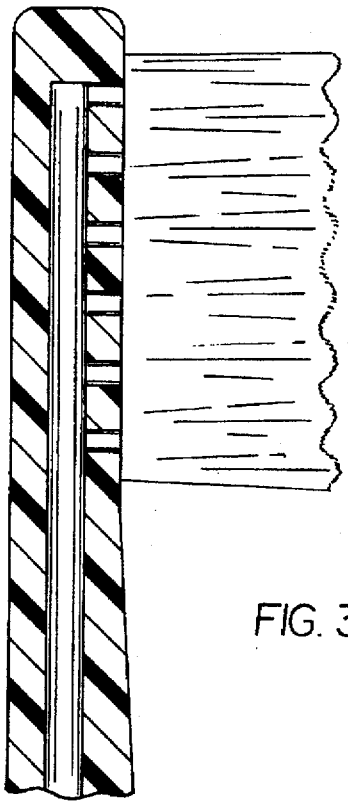
FIG. 3 is a cross-sectional view taken along line 3—3 of FIG. 2.
Figure 4:
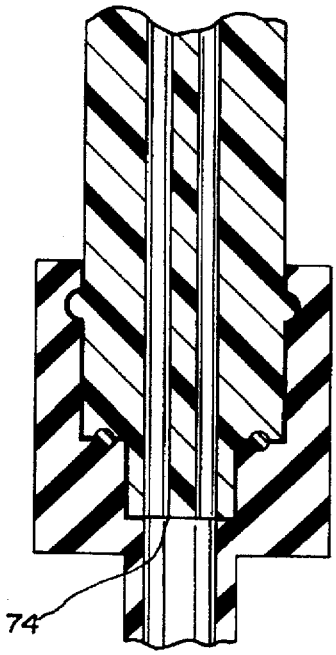
FIG. 4 is a cross-sectional view taken at the near end of the toothbrush of the prior Figure.
Figure 5:
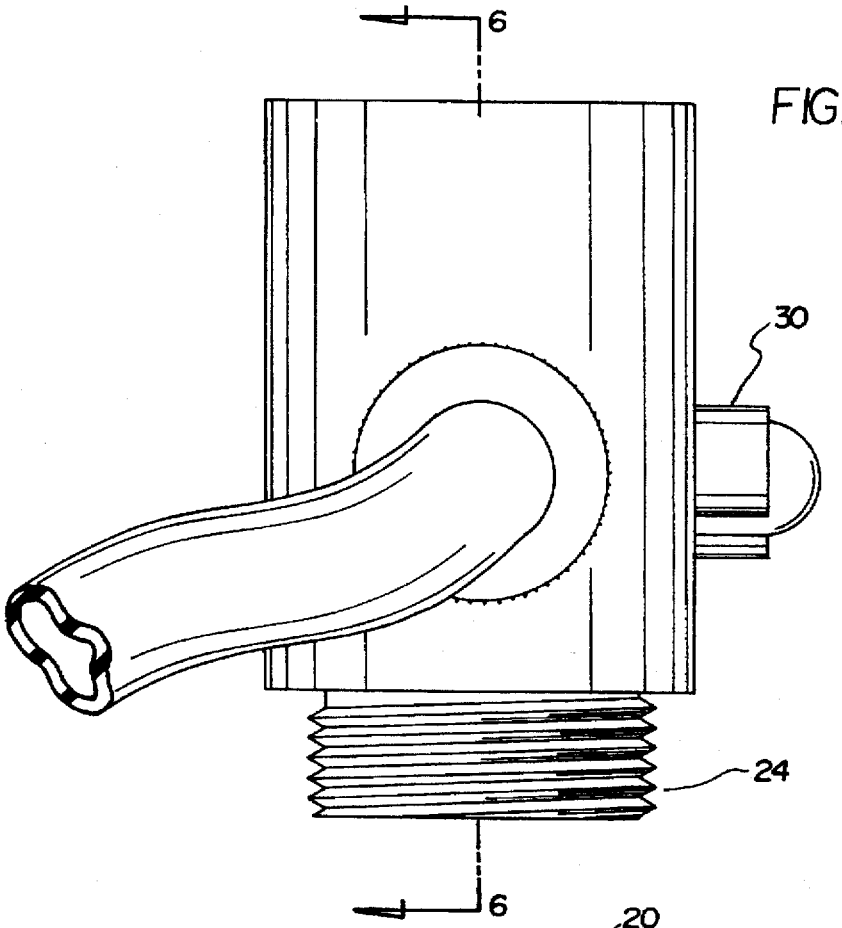
FIG. 5 is a enlarged perspective view of a portion of the shower head adapter illustrated in FIG. 1.

With reference now to the drawings, and in particular to FIG. 1 thereof, the preferred embodiment of the new and improved toothbrush system with an internal water delivery system operable from a shower embodying the principles and concepts of the present invention and generally designated by the reference numeral 10 will be described.

The present invention, the new and improved toothbrush system with an internal water delivery system operable from a shower is a system 10 comprised of a plurality of components. In their broadest context, the components include an adaptor, a toothbrush, and a hose. Each of the individual components is specifically configured and correlated one with respect to the other so as to attain the desired objectives.

One central component of the system 10 of the present invention is a hollow cylindrical adapter 12. Such adaptor is removably positionable on a shower between the water outlet line 14 and the shower head 16. The adaptor is formed to have an inlet end 18. The inlet end is formed with internal screw threads 20 for coupling to the water outlet line which brings the water to the shower head. The adaptor is also formed to have an outlet end 22. On the outlet end are external threads 24 for coupling to the shower head.

Figure 6:
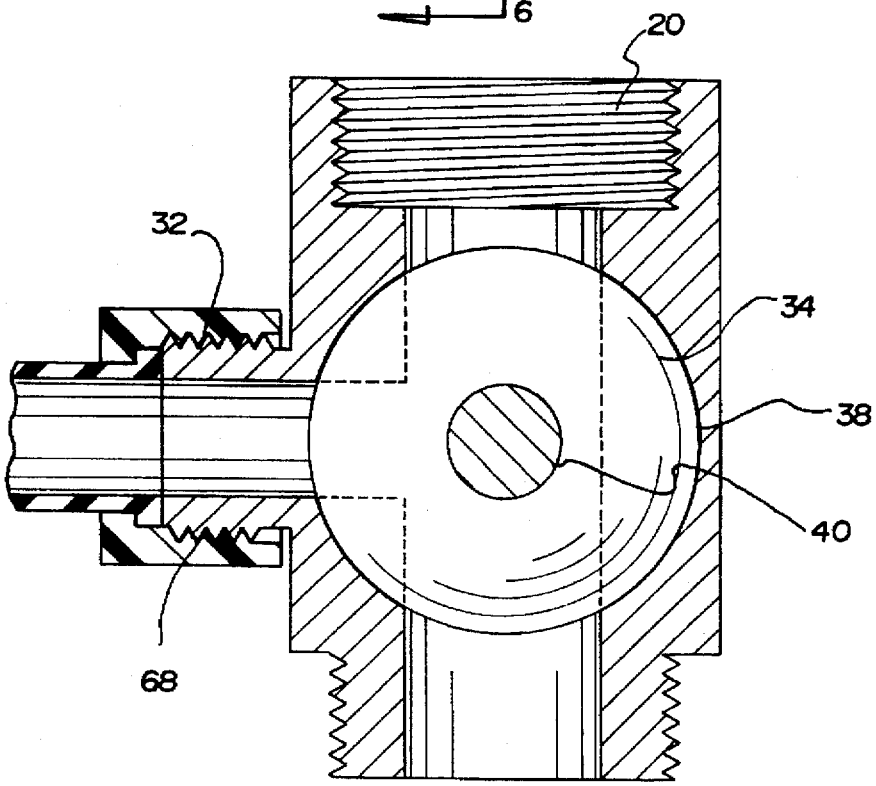
FIG. 6 is a cross-sectional view taken along line 6—6 of FIG. 5.
Figure 7:
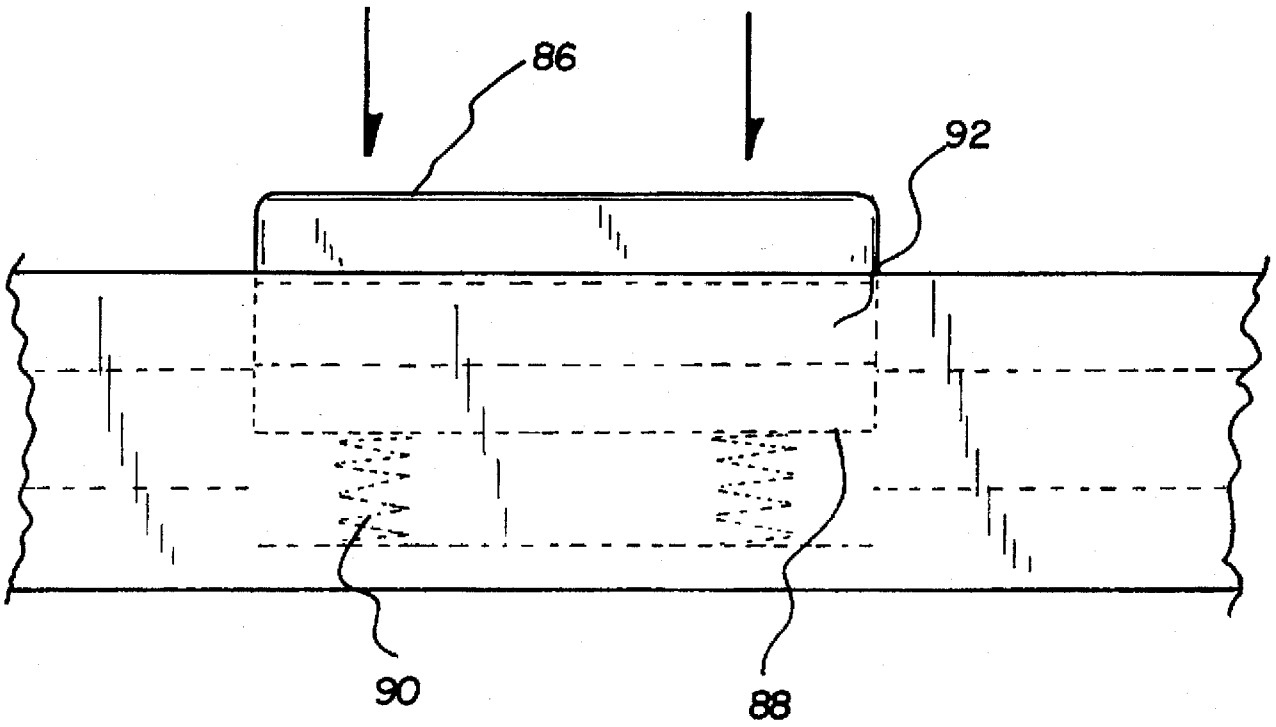
FIG. 7 is a side elevation view of the water release button of the present invention.

The adaptor is formed to have a centrally disposed radial aperture 28. An extension 30 with external threads 32 is formed to extend radially from one side of the adaptor. The adaptor is also provided with a rotatable ball-shaped valve 34. Such valve is coupled to an external handle 36 for adjustment purposes at the discretion of the user. The valve has a T-shaped opening with an enlarged central diametric opening 38. It is also formed with a smaller radial opening 40. The openings join together adjacent to a central region of the ball-shaped valve. The handle is adapted to position the valve in any one of a plurality of orientations as shown in FIG. 6. FIG. 6 shows the diametric opening in alignment with the opening through the adaptor for the flow of water to the shower head. The smaller radial opening is in alignment with the opening through the extension. In this manner, a flow of water is concurrently directed to the person showering as well as to the toothbrush of the person brushing his or her teeth as will be later described. Upon using to turn the handle 180 degrees from the orientation shown in FIG. 6, the flow of water will be to the shower head to the exclusion of the toothbrush. By turning the handle 90 degrees clockwise the flow of water will be to the toothbrush to the exclusion of the shower head. By turning the handle counter-clockwise 90 degrees no water will flow to the shower head or to the toothbrush. It should be understood that varying the handle and ball-valve to various degrees between these three major orientations as described above, different degrees of water may be directed concurrently to the shower and to the toothbrush in varying amounts as intended by a user.

The next major component of the system 10 is a toothbrush 44. The toothbrush has a far end 46. At the far end are outwardly extending bristles 48. The toothbrush also has a near end 50. The near end is formed with a rectilinear or box-like shape constituting a female connector. In association therewith there are a pair of parallel lines 52,54 extending along the length of the toothbrush in the area of the handle 56. A plurality of small apertures 58 are formed adjacent to the bristles near the far end. This is at a location at the internally terminal ends of the lines. The lines and apertures together allow for the dissemination of water from the lines through the apertures to the mouth and teeth of the person brushing his or her teeth.

Associated with the toothbrush 44 is a water release button 84. The water release button 84 is positioned intermediate end portions of the pair of parallel lines 52,54. The water release button 84 has an upper end 86 extending outwardly of the toothbrush 44. A lower end 88 of the water release button 84 has a pair of springs 90 disposed thereon. The water release button 84 further has a pair of horizontally disposed apertures 92 therethrough. The water release button 84 can be pressed down into the toothbrush 44 thereby allowing the apertures 92 to align with the pair of parallel lines 52,54 to allow for water to flow therethrough to the plurality of apertures 58 for dissemination outwardly thereof. A pair of protrusions (not shown) on the sides of the water release button 84 will engage a pair of recesses (not shown) within the toothbrush 44 to lock the release button 84 in a water flow orientation. Pressing downwardly on the water release button 84 again, will cause the protrusions to release from the recesses to disengage the water release button 84 thereby misaligning the apertures 92 from the pair of parallel lines 52,54 to stop the flow of water.

Lastly provided as part of the system 10 is a flexible hose 62. Such hose is provided with an upper end 64. The upper end is formed with a fitting 66. The fitting is formed with internal threads 68 for coupling with the threads of the extension of the adapter. The hose also has a lower end 70 in a rectilinear or box-like shape or configuration. Such lower end is for receiving the near end of the toothbrush.

The lower end of the hose has an annular recess 74. An associated O-ring is located within the annular recess. The function of the O-ring is to make a watertight seal between the toothbrush and the lower end of the hose during operation and use.

The toothbrush is also formed to have a radially outstanding flange 78. Such flange is adapted to be received in a complementary radial recess 80 in the lower end of the hose. This is to insure the coupling between the hose and the toothbrush during operation and use.

The present invention comprises a toothbrush that utilizes the water force delivered by a typical bathroom sink or shower. It is made from plastic and rubber, and consists of a handle, a detachable head, a disposable brush, a plastic or rubber hose, and a water switch valve. The handle has two parallel water channels running longitudinally along its full length with their inlet openings in the handle's bottom. Six water outlets project perpendicular from each channel in the head area. The head can be removed and replaced with a different one, enabling the toothbrush to be used by different family members. The brush slides in and out of a longitudinal track situated on the head. Fastened to the bottom is a hose containing two tubes. The hose's other end attaches to an outlet with a switch valve that is situated in the water line just prior to a faucet or shower head. The brush could be made as part of a kit that includes a shower holster for toothpaste, a water cup, and replacement heads.

To use, apply toothpaste to the brush, fasten the hose to an appropriately equipped bathroom water line, turn on the switch valve, and brush. The water also sprays around the teeth while brushing. The present invention enables one to utilize the water pressure from a sink or bathtub shower to clean the teeth, which should be less messy and save time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved toothbrush system with an internal water delivery system operable from a shower comprising, in combination:

a hollow cylindrical adapter removably positionable on a shower between the water outlet line and the shower head, the adapter having an inlet end with internal threads for coupling to the water outlet line bringing water to the shower head and having an outlet end with external threads for coupling to the shower head, the adaptor having a centrally disposed radial aperture with a threaded extension, the adaptor also having a rotatable ball-shaped valve with a T-shaped opening to direct the flow of water to the shower head to the exclusion of the radial aperture, to the radial aperture to the exclusion of the shower head, to neither the shower head nor the radial aperture and with a portion of the flow of water to the shower head and radial aperture;

a toothbrush having a far end with outwardly extending bristles and a near end with a connector and with a pair of parallel lines extending along the length thereof with a plurality of apertures adjacent to the bristles at the terminal ends of the lines for the dissemination of water from the lines and through the apertures; and a water release button positioned intermediate end portions of the pair of parallel lines, the water release button having an upper end extending outwardly of the toothbrush, a lower end of the water release button having a pair of springs disposed thereon, the water release button further having a pair of horizontally disposed apertures therethrough, the water release button pressing down into the toothbrush thereby allowing the apertures to align with the pair of parallel lines to allow for water to flow therethrough to the plurality of apertures for dissemination outwardly thereof;

a flexible hose having an upper end with a fitting formed with internal threads for coupling with the threaded extension of the adapter and having a lower end dimensioned for receiving the near end of the toothbrush, the lower end of the hose having an annular recess with an associated O-ring for making a watertight seal between the toothbrush and the lower end of the hose, the toothbrush also having a radially outstanding flange adapted to be received in a radial recess in the lower end of the hose for the coupling therebetween.

* * * * *